US007296716B2

(12) United States Patent
Mayzel

(10) Patent No.: US 7,296,716 B2
(45) Date of Patent: Nov. 20, 2007

(54) BELT MOUNTED ID/CREDIT CARD ANTI-THEFT DEVICE

(76) Inventor: John Anthony Mayzel, 1931 Hampshire Road, Victoria, B.C. (CA) V8R 5T9

( * ) Notice: Subject to any disclaimer, the term of this patent is extended or adjusted under 35 U.S.C. 154(b) by 610 days.

(21) Appl. No.: 10/729,933

(22) Filed: Dec. 9, 2003

(65) Prior Publication Data

US 2004/0169056 A1 Sep. 2, 2004

Related U.S. Application Data

(60) Provisional application No. 60/432,037, filed on Dec. 10, 2002.

(51) Int. Cl.
*A45C 1/04* (2006.01)

(52) U.S. Cl. ..... 224/673; 224/587; 224/684; 206/39; 206/39.1; 206/39.5

(58) Field of Classification Search ..... 224/673, 224/587, 660, 663, 665–669, 671, 674, 678, 224/679, 163; 206/39, 39.1, 39.3, 39.5, 39.6
See application file for complete search history.

(56) References Cited

U.S. PATENT DOCUMENTS 953,953 A * 4/1910 Inglee ..... 206/39.3
4,068,787 A * 1/1978 Craighead ..... 224/163
4,674,628 A * 6/1987 Prinsloo et al. ..... 206/38.1
4,790,435 A * 12/1988 Trusty ..... 206/39.5
4,853,676 A * 8/1989 Kitts ..... 340/543
5,586,707 A * 12/1996 Haskell ..... 224/684
6,089,289 A * 7/2000 Florjancic ..... 150/147
6,412,627 B1 * 7/2002 Tiscione et al. ..... 206/39.4
2002/0056652 A1 * 5/2002 Kawamura et al. ..... 206/37

FOREIGN PATENT DOCUMENTS

DE 3604020 A1 * 8/1987

* cited by examiner

*Primary Examiner*—Nathan J. Newhouse
*Assistant Examiner*—Jack Morgan
(74) *Attorney, Agent, or Firm*—J. Gordon Thomson

(57) ABSTRACT

A belt mounted ID/credit card anti-theft device for securely holding at least one such card. The device comprises a first rectangular body and a second elongate body. The first rectangular body includes a chamber adapted for receiving and securely holding the card. The second elongate body comprises means for demountably mounting the first rectangular body to a belt or strap and means for sealing the card securely within the chamber in a locked configuration. Another embodiment of the invention is disclosed wherein the rectangular body comprises a first front card holding chamber and a second rear card holding chamber. Various devices for attaching the device to a belt or strap are also disclosed.

20 Claims, 13 Drawing Sheets

BELT MOUNTED ID/CREDIT CARD ANTI-THEFT DEVICE

CROSS REFERENCES TO RELATED APPLICATIONS

This application is entitled to the benefit of my Provisional Patent Application Ser. No. 60/432,037 filed in the United States Patent and Trademarks Office on Dec. 10, 2002.

BACKGROUND OF THE INVENTION

1. Field of the Invention

This invention relates to anti-theft devices mounted to the person, and more particularly for a belt mounted ID/credit card anti-theft device.

2. Background of the Invention

With the proliferate use of credit cards, health cards and identification cards there is an increased potential for loss, theft and fraudulent misuse of these cards and the data contained on them. Pockets, wallets and purses do not offer the anti-theft characteristics necessary to protect these valuable objects. Money belts, often used to store such items, are cumbersome and uncomfortable to use. There have been several attempts to develop an anti-theft device to hold these types of items. One example is found in U.S. Pat. No. 4,068,787 entitled "Money Buckle" issued to Craighead on Jan. 17, 1978. Craighead teaches a storage device that is mounted to a belt and is particularly adapted for paper objects and uses a flap to secure the contents within the storage chamber. Craighead is not adapted for securely storing a plurality of modern credit cards and identification cards. The flap closure and outward positioning of the Craighead device leaves such valuable items stored within it vulnerable to loss and theft. Furthermore, Craighead cannot be easily demounted from the belt to which it is attached.

Given the increasing amount of information of a personal and commercial nature stored on modern cards, there is a continued need for an anti-theft device that can be easily worn by the wearer and provides a high degree of security to the contents stored in the device.

OBJECTS OF THE INVENTION

It is an object of the present invention to overcome the deficiencies in known anti-theft devices worn on the person.

Another object of the present invention is to provide a belt mounted anti-theft device for storing a plurality of identification cards and credit cards and the like.

Still another object of the invention is to provide a belt mounted anti-theft device that is able to be comfortably worn by the wearer on a waist belt or bag strap.

Another object of the invention is to provide a belt mounted anti-theft device that can be demounted from a belt without having to undo the belt.

SUMMARY OF THE INVENTION

The objects of the present invention are satisfied through the provision of a belt mounted ID/credit card anti-theft device adapted for securely holding at least one card. The anti-theft device comprises a first rectangular body and a second elongate body. The first rectangular body is dimensioned so as to receive and securely hold at least one card in a single chamber. The second elongate body is adapted to securely close the open end of the first rectangular body in a locking engagement and to fasten the first rectangular body to waist belt of the wearer or a strap on a bag or back pack worn by the wearer.

In another embodiment, the rectangular first body is adapted to hold a plurality of cards in two chambers.

Further objects and advantages will become apparent from a consideration of the ensuing description and drawings.

DETAILED DESCRIPTION

Preferred Embodiment

Figure 1:
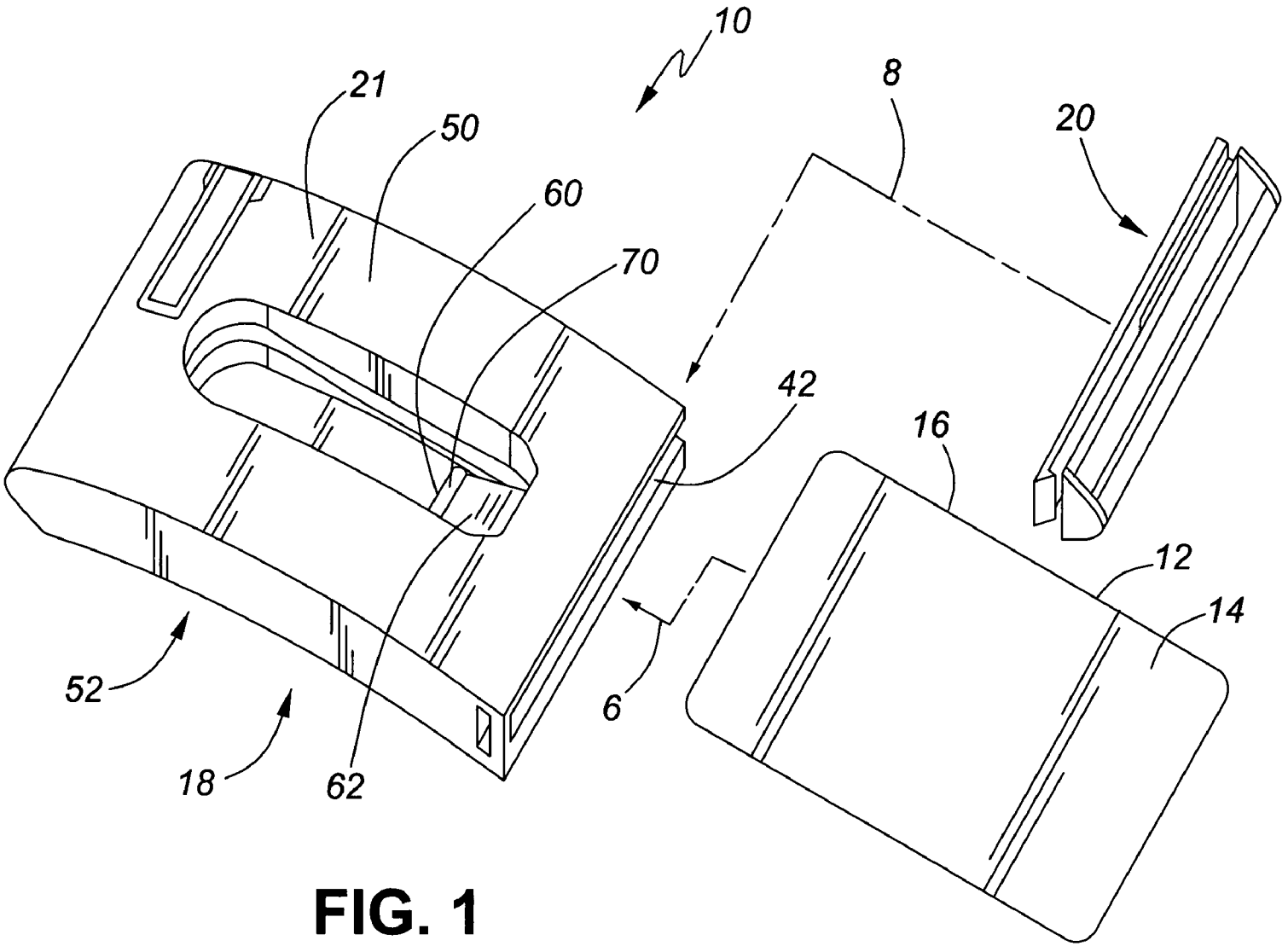
FIG. 1 is a view of the preferred embodiment of my invention adapted for holding at least one card in a single chamber.
Figure 2A:
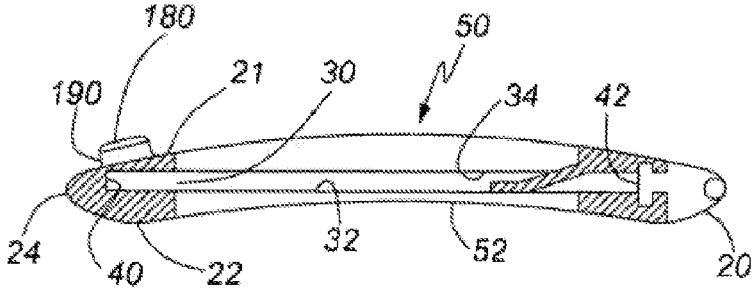
FIGS. 2A, 2B, 2C and 2D show a variety of views of the preferred embodiment of my invention.
Figure 2C:
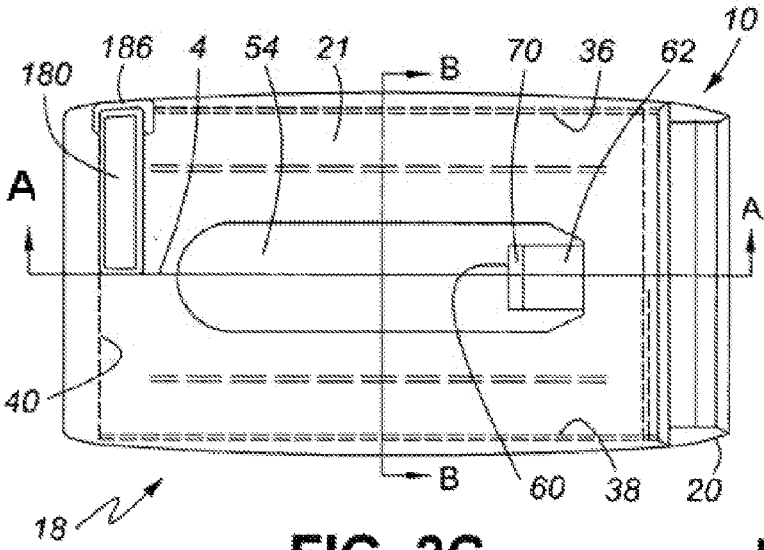
Figure 2B:
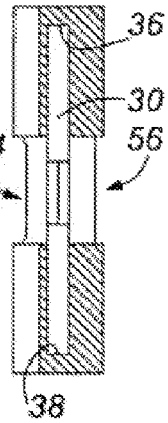
Figure 2D:
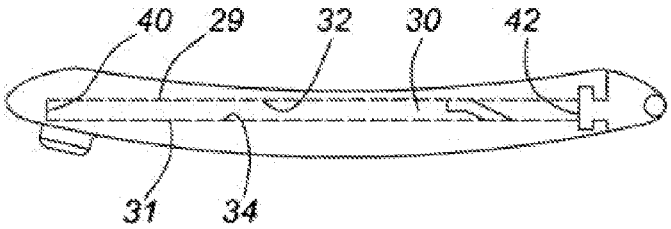

A preferred embodiment of my invention is shown in FIG. 1 as being a belt mounted ID/credit card anti-theft device generally illustrated as (10) for receiving and securely holding at least one card (12) as shown by movement line (6). The at least one card (12) has an upper surface (14) and a bottom surface (16). The belt mounted anti-theft device (10) comprises a first rectangular body (18) and a second elongate body (20) for demountably mounting rectangular body (18) to a belt and for lockably closing open end (42) of the first rectangular body (18) as shown by movement line (8) and as further described herein.

Referring now to FIG. 2, there are shown various views of my invention, A, B, C and D. View A shows Section A-A and illustrates a horizontal sectional view of the first rectangular body (18) with the second elongate body (20) fixed to it. View B shows Section B-B which is a vertical sectional view across the first rectangular body (18). View C is a front elevation view of the first rectangular body (18) wherein top portion (21) is facing the viewer. View D is a view of the top surface of the rectangular body (18).

Figure 3:
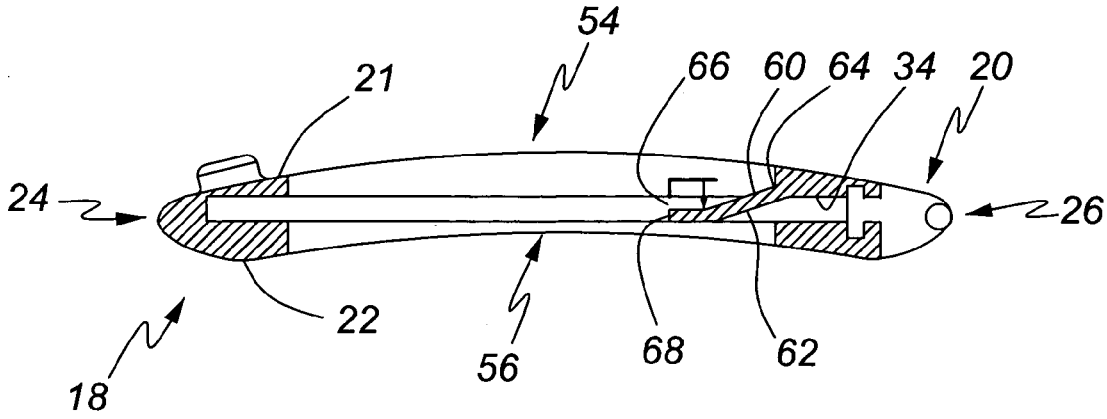
FIG. 3 shows a view of Section A-A identified in FIG. 2.

FIG. 3 isolates Section A-A for description purposes. It is to be understood that my invention will be molded using a light weight and resilient thermoplastic polymer. For the purpose, only, of describing the novel and inventive features of my device, I will describe the first rectangular body (18) as having an upper portion (21) and a bottom portion (22). A person skilled in the art of mold making will be able to use this detailed description in order to fabricate a mold in the most cost-effective and efficient manner available. The shape or type of mold or the manner of molding does not constitute an inventive aspect of my invention. However the use of modem, resilient thermoplastic polymers does constitute an inventive aspect of my invention. Furthermore, while it is understood that the device is fixed to a belt, for the purposes of illustration, the device depicted in FIG. 3 will be described as if it were placed on a flat surface. Continuing, the bottom portion (22) is cohesively joined to the upper portion (21) at first end (24). When the belt mounted anti-theft device is mounted to a belt, upper portion (21) faces away from the waist of the wearer and the device is positioned between the belt and the waist of the wearer. The bottom portion (22) is adjacent to the waist of the wearer. The concave shape of the bottom portion (22) is adapted to conform comfortably to the waist of the wearer. Furthermore the first end (24) of the first rectangular body (18) and the second end (26) of the second elongate body (20) are also contoured for comfort of the wearer while the device is on the belt or in hand. Since Section A-A- is along the mid-line (4) of first rectangular body (18), it intersects the oblong cut out (54) and (56) located in the upper portion (21) and lower portion (22) respectively.

Figure 4:
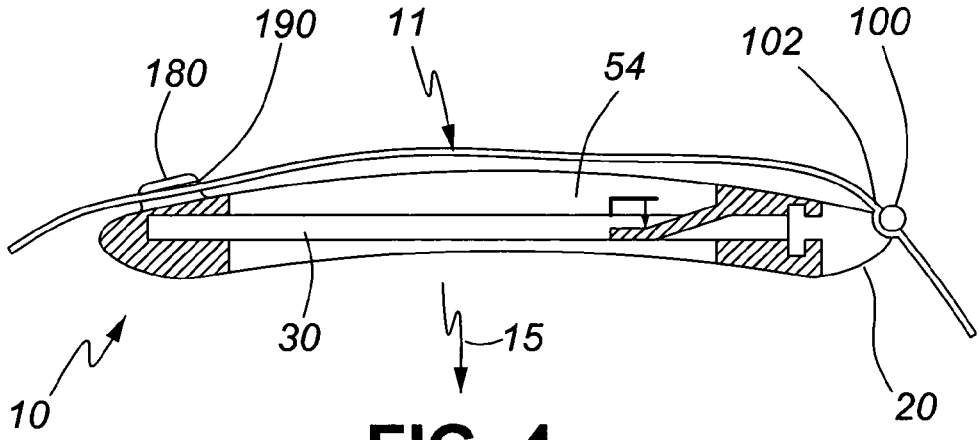
FIG. 4 shows another view of Section A-A identified in FIG. 2 showing the relationship between my invention and a waist belt.

Referring now to FIG. 4, the reader is provided with a further depiction of Section A-A showing the relationship between my invention (10) and a belt (11). Arrow (15) shows the direction of the waist of the wearer. Therefore, it is understood that the device is positioned behind the belt between the belt and the waist of the wearer. The belt (11) is held in place by finger member (180) as more fully explained herein. As well, belt (11) is looped through slot (102) in second elongate body (20) created by looping member (100) as more fully described herein with reference to subsequent figures. Belt (11) is positioned over oblong cut out (54). It is therefore, one advantage of my invention that once the card (12) is inserted into the chamber (30), second elongate body (20) acts to securely seal the chamber preventing the card from falling out. Furthermore, because my invention is located behind the belt of the wearer, the device remains invisible and theft is virtually impossible.

Referring back to FIG. 2, Section A-A and Section B-B, the joining at (24) of the top portion (21) and the bottom portion (22) forms a rectangular chamber (30). Referring as well to the top view of the invention (10) at view D, the rectangular chamber (30) shown in ghost lines (29) and (31) has a chamber floor (32) and a chamber ceiling (34). The chamber also includes a first closed side (36) and a second closed side (38). The chamber (30) also has a first closed end (40) and a second open end (42). FIG. 2 is depicted with the first rectangular body (18)joined to the second elongate body (20). FIG. 1 shows second elongate body (20) detached from first rectangular body (18) and the second open end (42).

Referring to FIG. 1 and FIG. 2, upper portion (21) comprises a planer lower surface (34) and a convex upper surface (50). The planer lower surface (34) forms the chamber ceiling. The lower portion (22) comprises a planer upper surface (32) and a convex lower surface (52). The planer lower surface (32) forms the chamber floor. The convex and concave surfaces of the device are adapted so that the device conforms comfortably to the waist of the wearer and in hand use.

Referring to FIG. 2 and FIG. 3, my belt mounted anti-theft device upper portion (21) includes a first centrally positioned oblong cutout (54) that is adapted to permit sliding thumb contact with the upper surface (14) of the card (12) held in the chamber (30). Similarly, the lower portion (22) includes a second centrally positioned oblong cutout (56) adapted to permit sliding thumb contact with the lower surface (16) of the card (12) held in the chamber (30). As illustrated in FIG. 1 and FIG. 2, the centrally positioned oblong cutouts (54) and (56) of the upper (21) and lower (22) portions respectively are identical in shape and positionally opposed to each other across the chamber (30).

Referring to FIG. 1 and FIG. 3 there is shown my belt mounted anti-theft device further including a biasing element (60) positioned within the chamber (30). The biasing element (60) is adapted for exerting a securing biasing force against the bottom surface (16) the card (12) contained within the chamber (30). The biasing element comprises a resilient rectangular biasing member (62) having a base (64) fixed cohesively to the ceiling (34) of the chamber (30). The biasing member (62) projects with a negative acclivity (66) from base (64) and includes a free second end (68). The free second end (68) has an oblate portion (70) that terminates adjacent to the first centrally positioned oblong cutout (54) and is adapted for sliding contact with the bottom surface (16) of the card (12). The biasing element (60) acts cooperatively with the bottom portion (21) to bias the top surface (14) of the card (12) within chamber (30) against the floor of the chamber (32) thereby maintaining it securely within the chamber.

Figure 6:
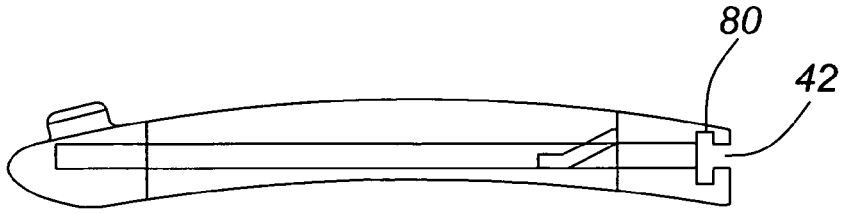
FIG. 6 shows another view of Section A-A identified in FIG. 2 illustrating the T-slot.
Figure 5:
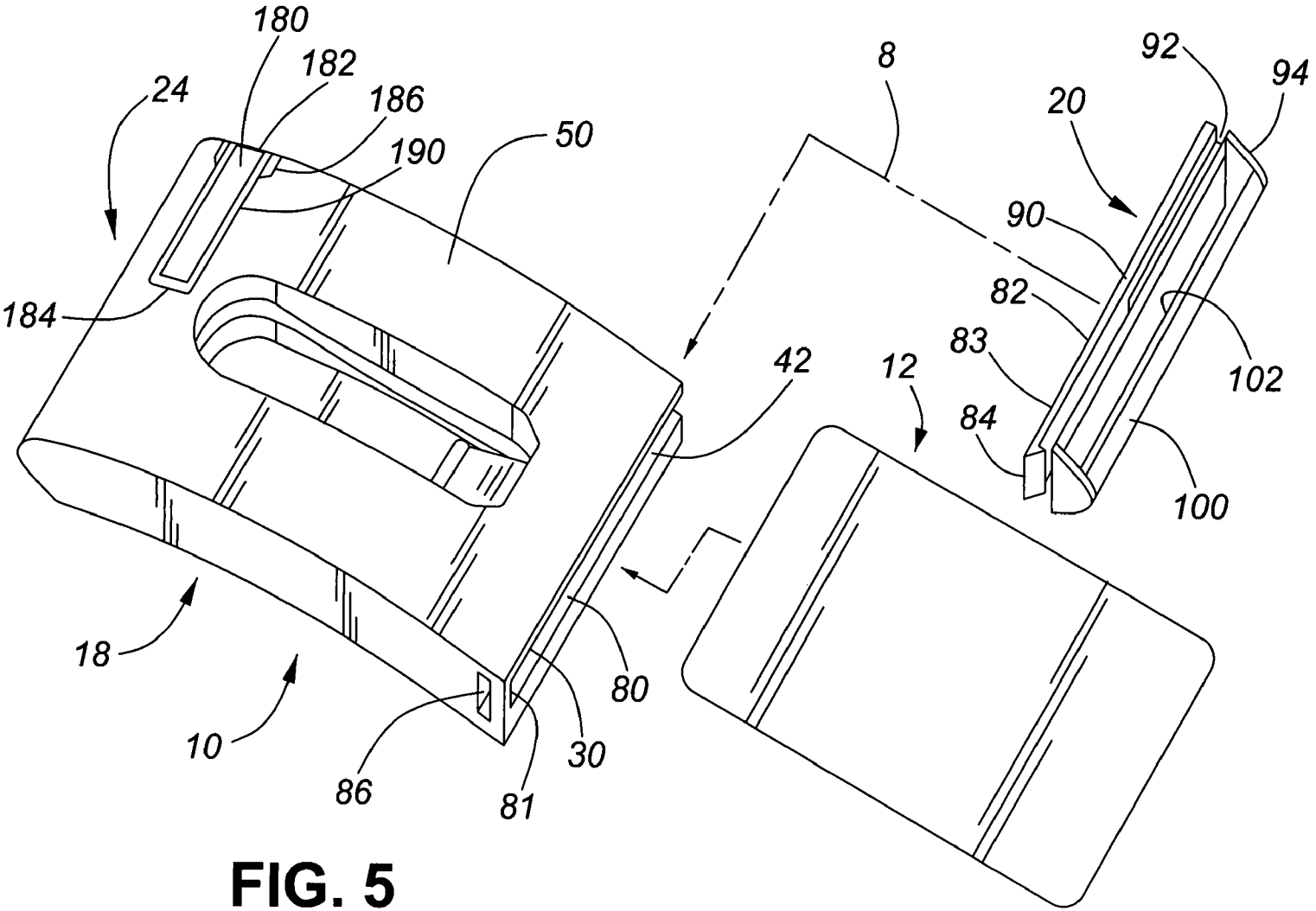
FIG. 5 is the same figure as FIG. 1 and describes additional details of the preferred embodiment of my invention.

Refer now to FIG. 5 which is identical to FIG. 1. In FIG. 5, my invention (10) is shown as having a first rectangular body member (18) and a second elongate member (20). The elongate member (20) is adapted for securely sealing second open end (42) once the card (12) is inserted into the chamber (30). Referring to FIG. 6, there is shown yet another depiction of Section A-A across first rectangular body (18) with second elongate body (20) detached. There is shown T-slot (80) which is adapted to accept the locking member (82) attached to the elongate second elongate body (20). T-slot (80) is interposed transversely across the second open end (42). Locking member (82) is adapted for sliding engagement within the T-slot (80) as depicted by movement line (8). In this way, when locking member (82) is engaged within the T-slot (80) the entire open second end (42) is lockably sealed. The locking member (82) further includes a triangular shaped locking stud (84) fixed to the free end (83) of the member (82). The locking stud (84) is adapted to resiliently engage locking orifice (86) at the base (81) of T-slot (80) so that when engaged, the member (82) is locked into position within the T-slot (80).

Figure 7:
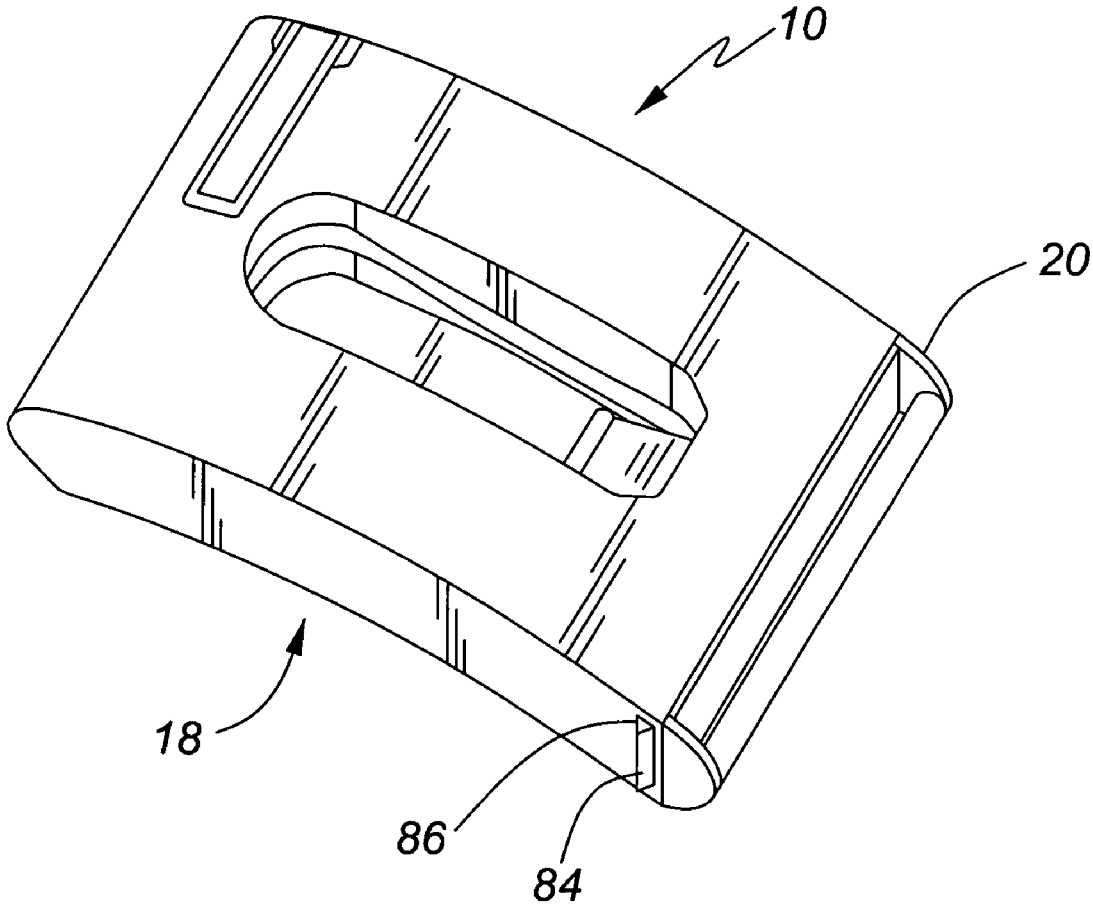
FIG. 7 is a view of the preferred embodiment of my invention with the second elongate body fixed to the first rectangular body for securing the contents of the chamber.

Referring to FIG. 7, there is shown my invention (10) wherein the second elongate body (20) is attached in a locked engagement to the first rectangular body (18). To remove the locking member from the T-slot, it is simple matter of depressing the resilient member (82) by way of locking stud (84) thereby disengaging the locking stud from the locking orifice (86) and sliding member (82) and the second elongate body (20) out of the T-slot.

Figure 8A:
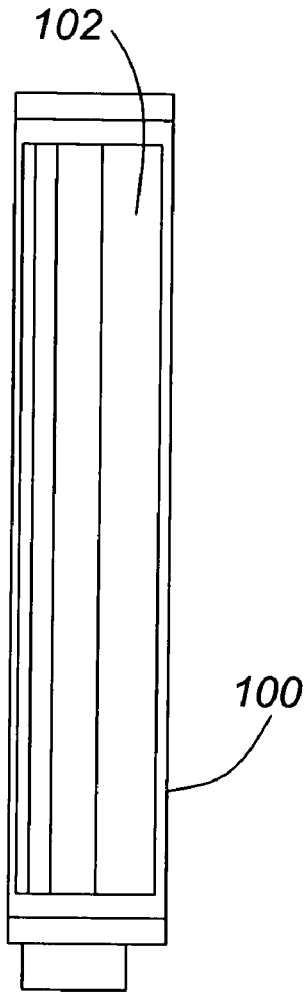
FIGS. 8A, 8B and 8C show multiple views of the second elongate body used for attachment to the first rectangular body.
Figure 8B:
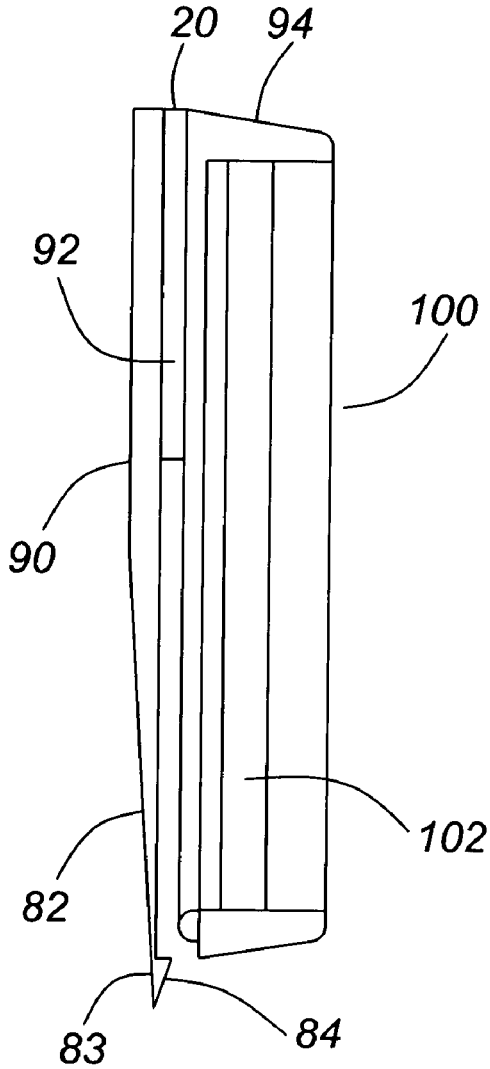
Figure 8C:
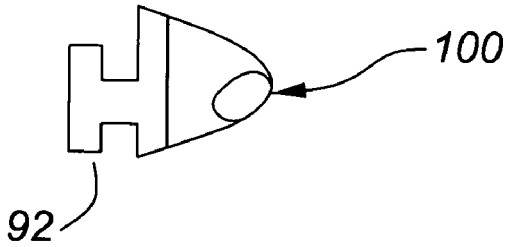

Referring to FIG. 8, there are shown three views A, B and C of the second elongate body (20) of my invention. Referring first to view B, there is shown the resilient locking member (82) fixed to the second elongate closing body (20). Locking stud (84) is also shown at the free end (83) of member (82). The fixed end (90) of member (82) is positioned intermediate the length of the second closing body (20). Fixed end (90) of the member (82) depends from breach (92) that is adapted for sliding engagement with T-slot (80). Breach (92) commences at the top end (94) of the second elongate body (20) and terminates at the same point that member (82) commences, that is, intermediate the length of the second elongate body (20). FIG. 5 shows another view of the breach (92). The cross section of breach (92) is shown in view C, a top end view, in FIG. 8, and is T-shaped to conform to the shape of T-slot (80) so that when the member (82) is locked into place, the breach (92) is interposed within the T-slot (80) in a snug and secure fit. When locking stud (84) is disengaged from locking orifice (86), a light effort will be required from the wearer to withdraw second elongate body (20) from the T-slot (80).

Still referring to FIG. 8, there is shown means for demountably mounting my invention to a belt. In this preferred embodiment of second body (20) there is included a looping member (100) fixed cohesively to second body (20). The looping member (100) is positioned on the closing body (20) so as to create a slot (102) between the second body (20) and the looping member (100). The slot (102) is adapted to receive a belt. FIG. 5, also illustrates looping member (100) and slot (102). As depicted in FIG. 4, Section A-A, the belt (11) is placed through slot (102).

When the wearer of the devices wishes to retrieve a card from the device, the wearer can easily disengage second elongate member (20) from first rectangular body (18) by depressing the locking stud (82) and resilient member (82) thereby disengaging the locking stud (84) from the locking orifice (86). Some controlled effort is required by the wearer to slide member (82) out of the T-slot (80) so the wearer can maintain control of the movements. The finger (180) is easily disengaged from the belt by a slight pull. The cards can now be dispensed by the wearer's thumb moving frictionally across the exposed upper or lower surface of the card through the orifice (54) or (56). Second elongate body (20) remains attached to the waist belt. When the wearer is finished with the card, the card is reinserted into the chamber, and the second elongate body is engaged by way of locking member (82) with the first rectangular body. The locking stud engages the locking orifice with an audible click to tell the wearer that the second elongate body is property attached and the device is securely closed. This same action reattaches first rectangular body to the waist belt. Finger (180) can be re-engaged with the belt and the anti-theft device is once more securely locked onto the belt of the wearer and invisible to casual on lookers.

Alternative Embodiments of the Looping Member

Figure 9A:
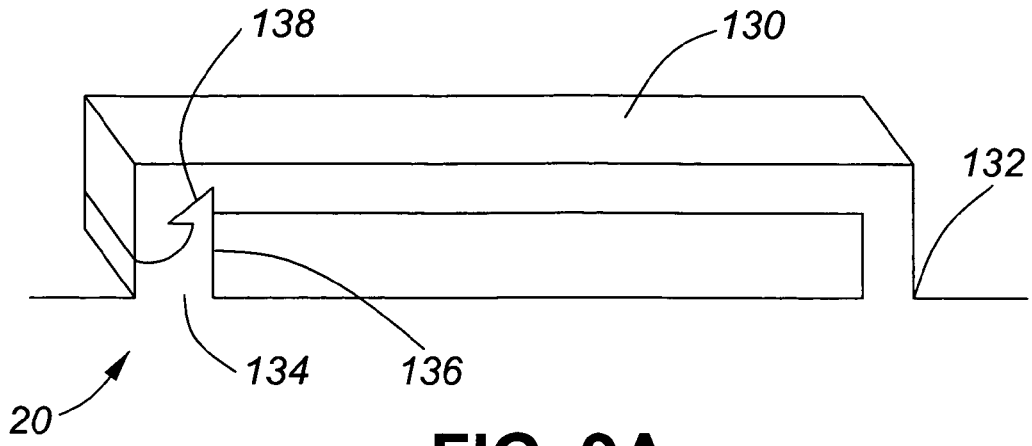
FIGS. 9A and 9B illustrate yet another embodiment of the looping member of my invention.
Figure 9B:
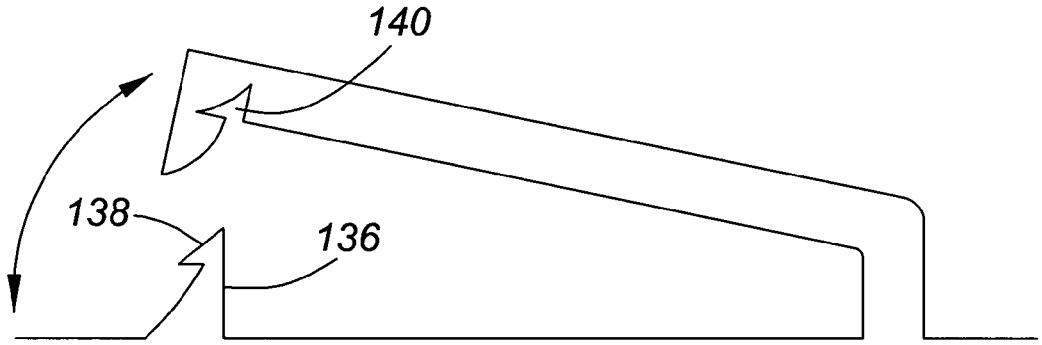
Figure 10A:
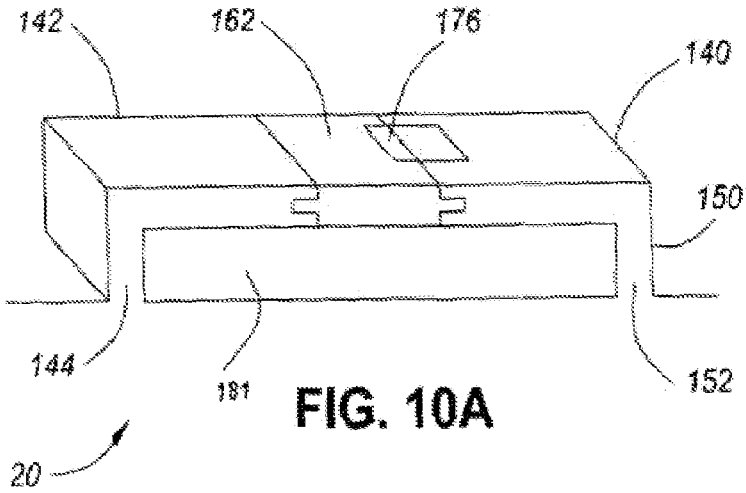
FIGS. 10A, 10B and 10C illustrate still another embodiment of the looping member of my invention.
Figure 10B:
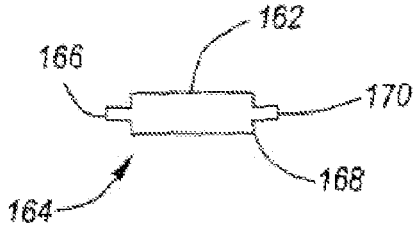
Figure 10C:
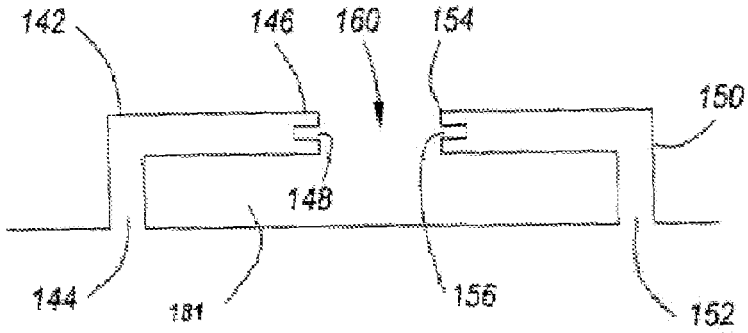

Referring to FIG. 9, there is shown another embodiment of my invention wherein the looping member (130) is fixed cohesively to the second elongate body (20) and has a first fixed end (132) and a second lockable openable end (134). FIG. 10, view A, shows the looping member (130) in its closed position. The member lockable openable end (134) comprises an upright part (136) having a triangular-shaped head (138). Head (138) is adapted for engagement with similar shaped orifice (140) within the looping member opening end. There is some resiliency in the polymer from which the looping member is made and therefore the lug head (138) and the orifice (140) will easily snap together in a locking manner. The looping member can be opened by exerting sufficient upwards force on the looping member opening end to over come the engagement of the head (138) and orifice (140).

Referring to FIG. 10, there is shown yet another embodiment of the looping member. Referring to view A, in this embodiment looping member (140) comprises three sections: a first section (142) has a first end (144) fixed to the second elongate closing body (20) and a second free end (146) having a groove (148) therein. There is a second section (150) having a first end (152) fixed to the second elongate closing body (20) and a second free end (154) having a groove (156) therein. The first section (142) free end (146) and the second section (150) free end (154) are opposed to each other across a gap (160). Filling gap (160) is third section (162) having a first end (164) and a tongue (166). The tongue (166) is adapted for engagement with groove (148). The third section (162) has a second end (168) with a tongue (170) adapted for engagement with groove (156). Third section (162) is lockably removeable from the gap (160) by a locking means (176). When the third section is out of the gap, the looping member can engage a strap into slot (181). Subsequently, the third member can be locked in place to close gap (160).

Referring now back to FIG. 2, FIG. 4 and FIG. 5, there is shown a finger (180) having a first end (182) fixed to the top portion of the rectangular first body (18) and a second free end (184). Finger (180) fixed end (184) is cohesively fixed by way of an elevating shim (186) to the upper convex surface (50) of the top portion (21) of the first rectangular body (18). The finger (180) is mounted to the first rectangular body (18) in such a way so that it is raised above and parallel to the upper convex surface (50) of the top portion (21) thereby creating a gap (190) between the finger and the surface (50). Furthermore, the finger (180) is positioned adjacent to the first closed end (24) of the first rectangular body (18). The finger (180) has an inherent resiliency. Finger (180) and gap (190) are adapted to engage belt (11) in a snug overlapping relationship so as to securely hold device adjacent to and behind the belt. This is illustrated in FIG. 4 which shows the finger (180) in an overlapping relationship with belt (11). The resiliency of finger (180) ensures that the belt (11) is held firmly within gap (190).

Figure 11A:
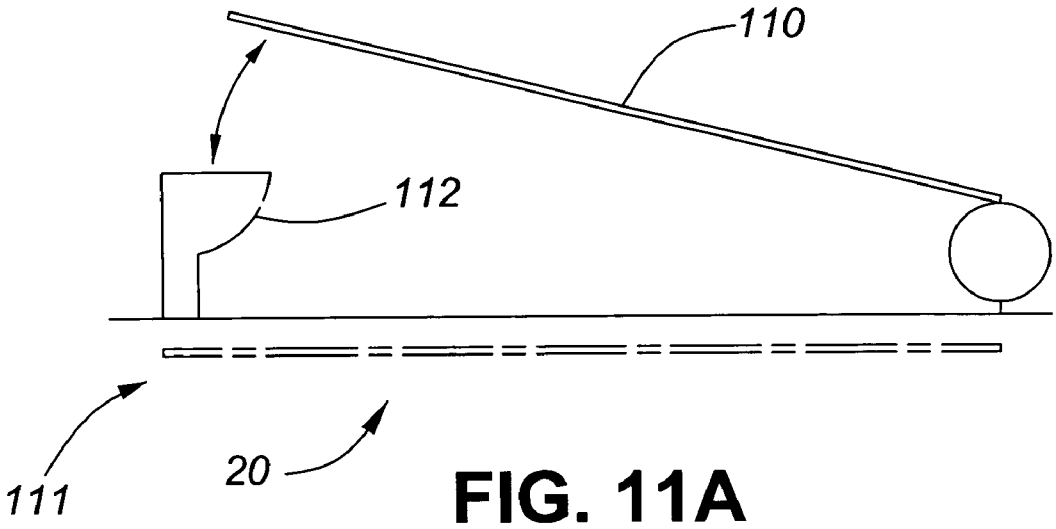
FIGS. 11A and 11B illustrate a pin clasp to fasten my invention to fabric material.
Figure 11B:
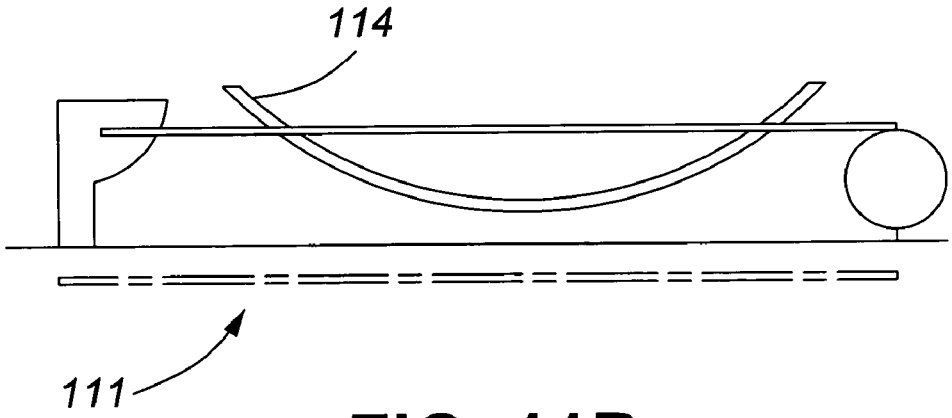

Referring now to FIG. 11, there is shown attachment means (111) for attaching my invention to fabric material. There is shown a pin member (110) and a clasping element (112) adapted to engage the pin member (110). The attachment means (111) is fixed to the second elongate body (20) and is adapted for attachment to fabric material such as might be found in a jacket, swim wear or inside surface of a pant pocket or any other situation where a belt or strap is not available to fasten my invention. View A shows the attachment means in a first open position and view B shows the attachment means in a second closed position with pin member (110) engaged by clasping element (112).

Alternate Embodiment of the Invention

Another alternate embodiment of my invention is illustrated in FIGS. 12 to 16. In this embodiment (200) there is a first rectangular body (202) and a second elongate body (204). The first rectangular body is adapted to securely house a plurality of cards (12) in two chambers. Referring to FIG. 13 there is shown a variety of views A, B, C and D of this embodiment of my invention. View A is a cross sectional view across first rectangular body (202) horizontal line A-A. View B is a cross sectional view across first rectangular body (202) vertical line B-B. View C is a left side view of rectangular body (202); view D is a front elevation view of the rectangular body (202).

Figure 14:
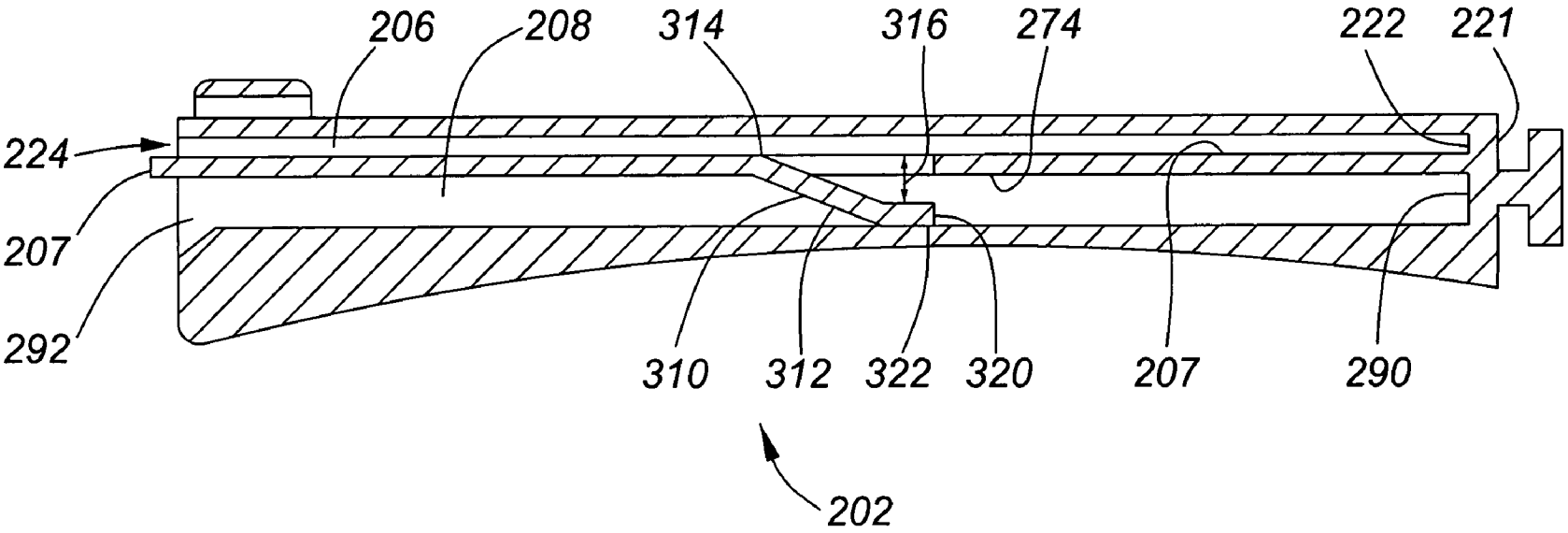
FIG. 14 illustrates Section A-A identified in FIG. 13.
Figure 15:
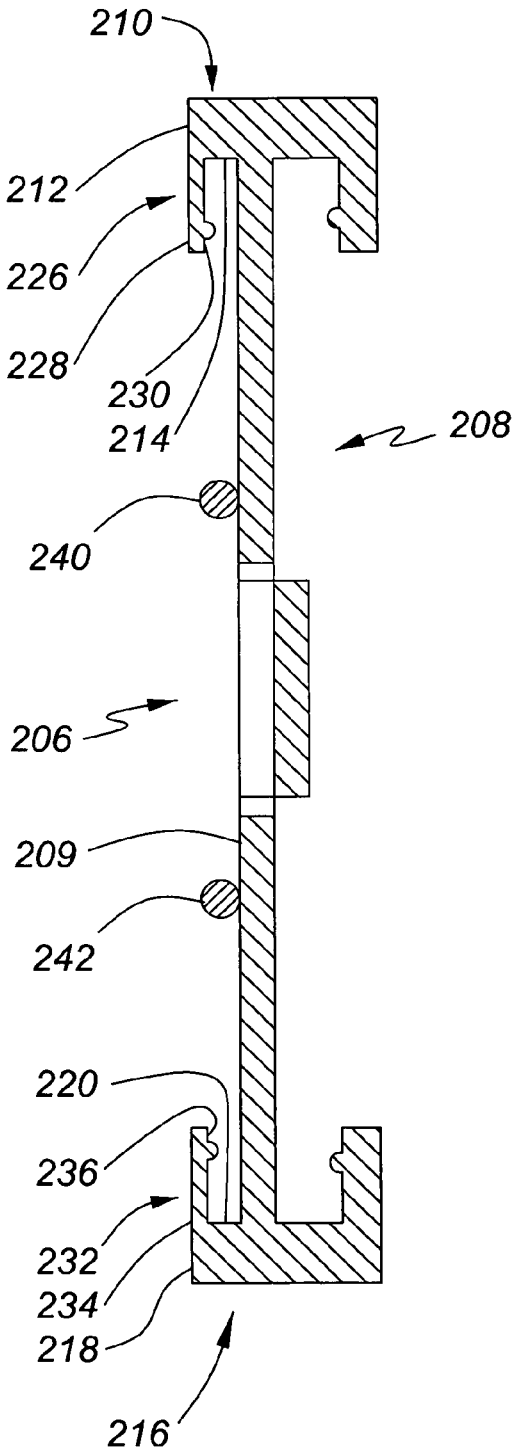
FIG. 15 illustrates Section B-B identified in FIG. 13 for description of the first chamber.

Referring now to FIG. 14 and FIG. 15, there is shown view A, Section A-A, and view B, Section B-B in greater detail for descriptive purposes. First rectangular body (202) is illustrated detached from second elongate body (204). First rectangular body (202) includes a first front chamber (206) and a second rear chamber (208) separated by dividing member (207). Both chambers are adapted to receive and securely contain at least one card. First front chamber (206) includes a floor (209), a top wall (210) having an upper surface (212) and an inside surface (214). There is bottom wall (216) having an upper surface (218) an inside surface (220). There is a front wall (221) having an inside surface (222). There is an open back end (224). The first front chamber (206) is adapted to accept at least one card in a sliding engagement through the open back end (224). The front wall inside surface (222) acts as a card abutment. There is also included a top wall mounted restraining member (226) that has an upper surface (228) and a lower surface (230). There is further a bottom wall mounted restraining member (232) that has an upper surface (234) and a lower surface (236). The top wall inside surface (214), the bottom wall inside surface (220), the front wall inside surface (222) and the open back end (224) generally define the card (12) dimensions so that when the card (12) is inserted into the first front chamber (206) the card is securely enclosed within the body. When the card (12) is enclosed within the front chamber (206) the top wall inside surface (214) and the bottom wall inside surface (220) are in frictional sliding engagement with the card to restrain it within the chamber.

Still referring to FIG. 13 and 15, the floor (209) of the first front chamber (206) includes at least two spaced apart parallel linear embossments (240) and (242) in a spaced relationship parallel to the top wall (210) and the bottom wall (216). The at least two spaced apart parallel linear embossments commence proximate to the open back end (224) and terminate proximate to the front wall (222). The at least two spaced apart parallel linear embossments are adapted to raise the card (12) above the floor (209).

The top wall upper surface (212) and the top wall mounted restraining member upper surface (228) are flush and contiguous. As well, the top wall mounted restraining member (226) extends into said first front chamber (206) between the open back end (234) and the front end (222). In the embodiment shown the length of the top wall mounted restraining member is equal to the length of the at least one card. However, in another embodiment, the length of the top wall mounted restraining member is less than the length of the at least one card.

The bottom wall upper surface (218) and the bottom wall mounted restraining member upper surface (234) are flush and contiguous. The bottom wall mounted restraining member (232) extends into the first front chamber between the open back end (234) and the front end (222). The length of the bottom wall mounted restraining member is less than the length of the at least one card. However, in another embodiment, the length of the bottom wall mounted restraining member is less than the length of the at least one card. In this other embodiment the bottom wall restraining member and the top wall mounted restraining member are parallel to each other and are in positional agreement opposite each other across the open face of the first chamber.

In operation, the at least two spaced apart parallel linear embossments (240) and (242) and the respective lower surfaces (230) and (236) of the top and bottom wall mounted restraining members (226) and (232) respectively act cooperatively on the card inserted into the first front chamber. Once the card is inserted, the respective lower surfaces (230) and (236) of the top (226) and bottom (232) wall mounted restraining members are in sliding frictional engagement with the upper surface (14) of the card (12) and the at least two spaced apart linear embossments (240) and (242) are in sliding frictional contact with the lower surface (16) of the card (12). This creates flexure in the card and resulting in biasing forces between the card and the respective lower surfaces of the top and bottom wall mounted restraining members that serve to maintain the card securely within the receptacle.

Figure 16:
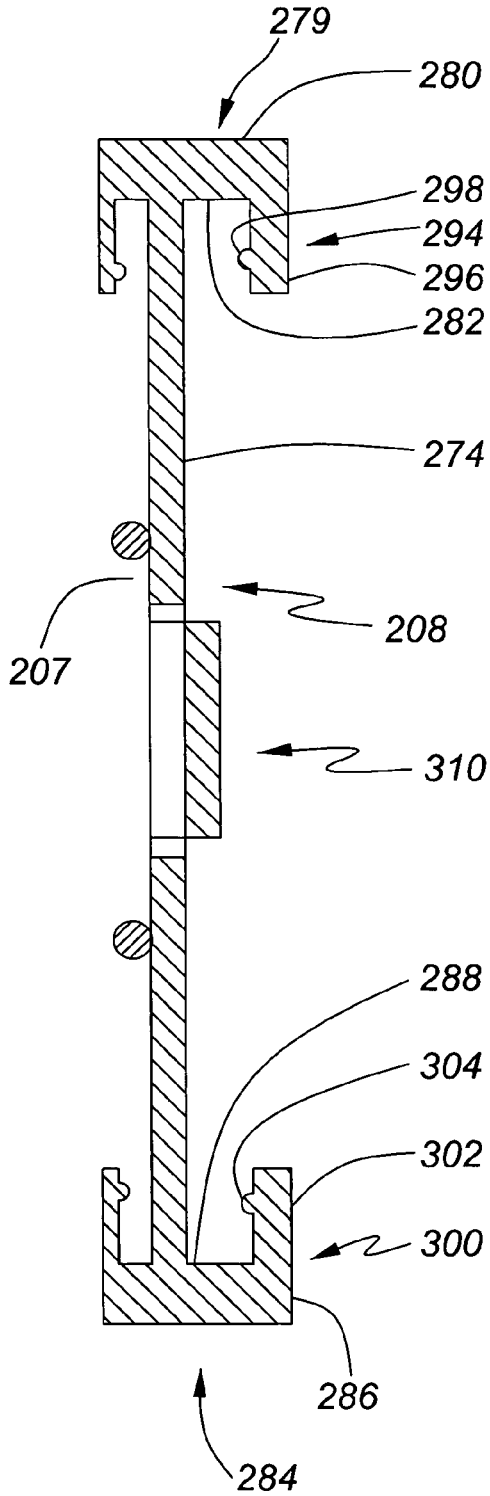
FIG. 16 again illustrates Section B-B identified in FIG. 13 for description of the second chamber.

Referring to FIGS. 14 and 16, there is, on the opposite side of the dividing member (207) a second rear chamber (208) having a floor (274). The second rear chamber (208) includes a second top wall (279) having a second upper surface (280) and a second inside surface (282), a second bottom wall (284) having a second upper surface (286) a second inside surface (288), a second front wall (290) and a second open back end (292). The second chamber (208) is adapted to accept at least one card (12) in a sliding engagement through the open second back end (292). The second front wall inside surface (290) acts as a card abutment. The second chamber (208) includes a second top wall mounted restraining member (294) having an upper surface (296) and a lower surface (298); and, a second bottom wall mounted restraining member (300) having an upper surface (302) and a lower surface (304). The second top wall inside surface (282), the second bottom wall inside surface (288), said second front wall (290) and the second open back end (292) generally define card (12) dimensions. The second top wall inside surface (282) and the second bottom wall inside surface (288) are in frictional sliding engagement with the card to restrain it within chamber (208).

In the second chamber, there is a cantilevered biasing element (310) rising from the second floor (274). This cantilevered biasing element (310) is positioned in the middle of the dividing member and is adapted to exert a bias on the bottom surface (16) of the card (12) inserted into the second chamber (208).

The second top wall upper surface (280) and the second top wall mounted restraining member upper surface (294) are flush and contiguous and the second top wall mounted restraining member (294) extends into second chamber (208) between the open back end (292) and the front end (290). The length of the second top wall mounted restraining member is at least equal to the length of the second at least one card.

The second bottom wall upper surface (302) and the second bottom wall mounted restraining member upper surface (300) are flush and contiguous and the second bottom wall mounted restraining member (300) extends into said second chamber (208) between the second open back end (292) and the second front end (290). The length of the second bottom wall mounted restraining member is at least equal to the length of the at least one card. The second top wall mounted restraining member and the second bottom wall restraining member are parallel and are in positional agreement opposite each other across the second chamber (208).

Biasing element (310) is adapted for exerting a securing biasing force against the bottom surface (16) the card (12) contained within the chamber (208). Referring to FIG. 14, the biasing means comprises a resilient rectangular biasing member (312) having a base (314) fixed cohesively to the floor (274) of the chamber (208). The biasing member (310)

projects with a negative acclivity (316) from base (314) and includes a free second end (320). The free second end (320) has an 10 oblate portion (322) and is adapted for sliding contact with the bottom surface (16) of the card (12).

The biasing element (310) acts cooperatively with the respective lower surfaces (298) and (304) of the second top and second bottom wall mounted restraining members (294) and (300) on the card (12) inserted into the second chamber (208), so that the respective lower surfaces (298) and (304) of the second top and bottom wall mounted restraining members (296) and (300) are in sliding frictional engagement with the upper surface (14) of the card (12), and so that the top oblate surface (322) of the biasing element (310) is in sliding frictional contact with the lower surface (16) of the card (12) thereby creating flexure in the card and resulting in biasing forces between the card and the respective second lower surfaces of the top and bottom wall mounted restraining members that serve to maintain the second card securely within the second receptacle.

Figure 12:
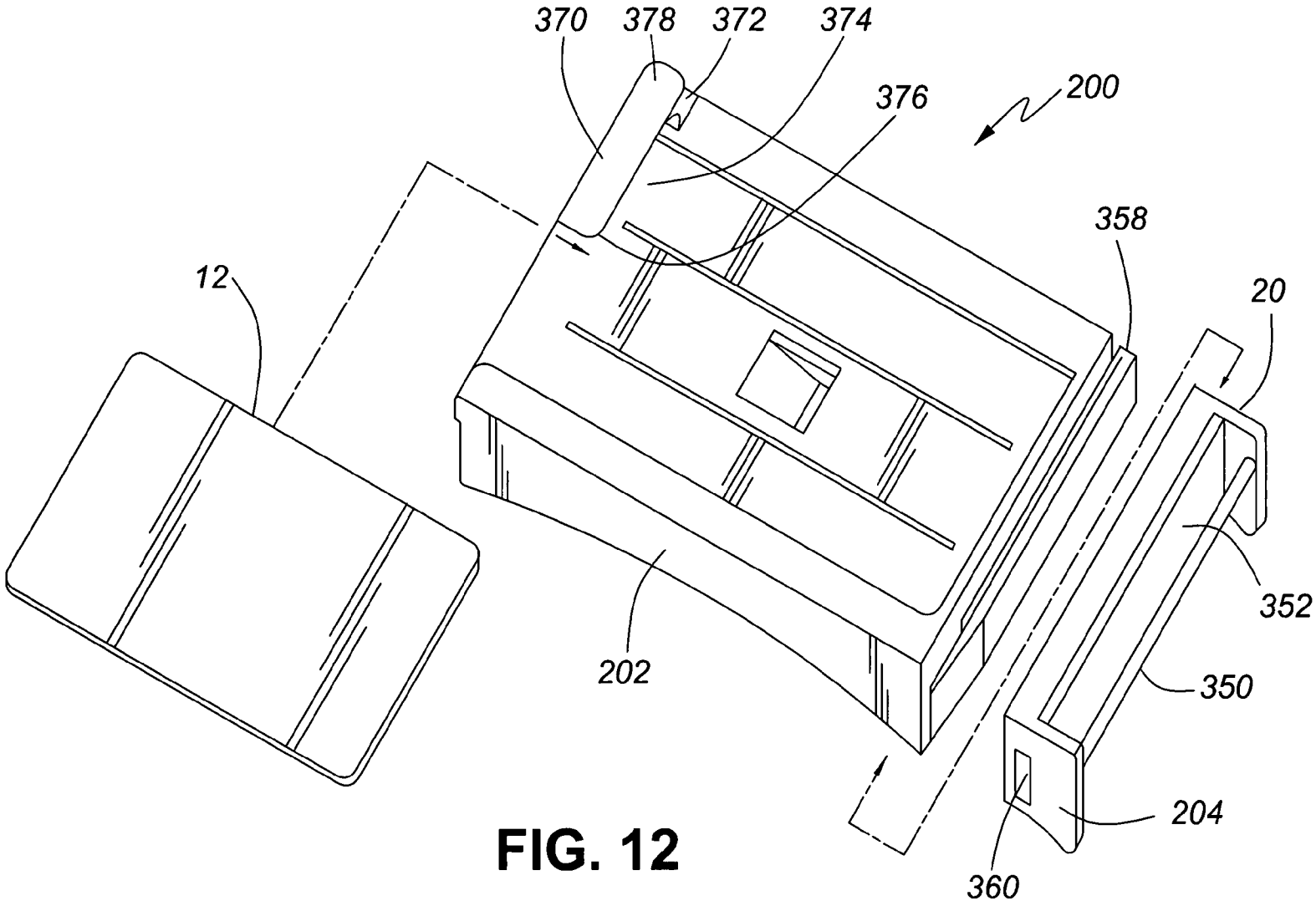
FIG. 12 illustrates a second embodiment of my invention having two card storage chambers.
Figure 13A:
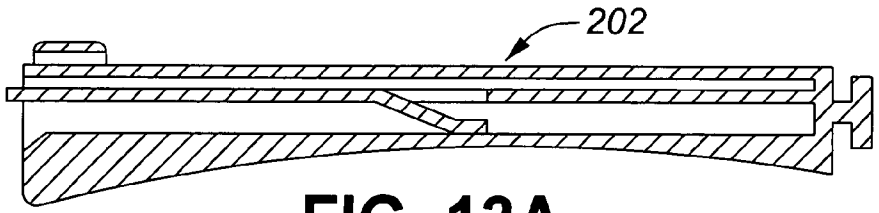
FIGS. 13A, 13B, 13C and 13D illustrate a plurality of views of the second embodiment of my invention.
Figure 13D:
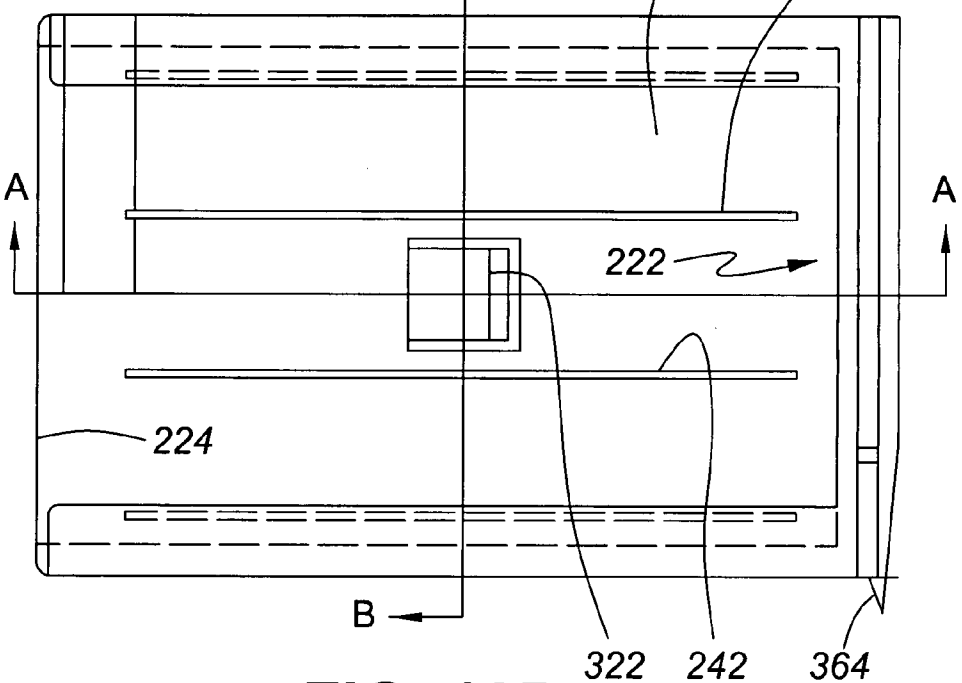
Figure 13C:
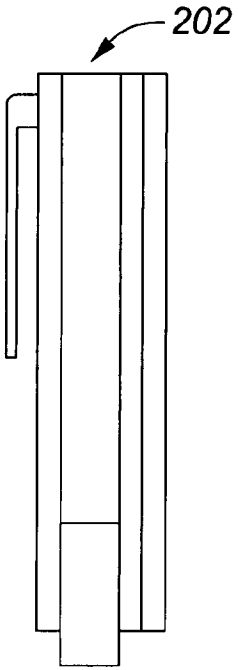
Figure 13B:
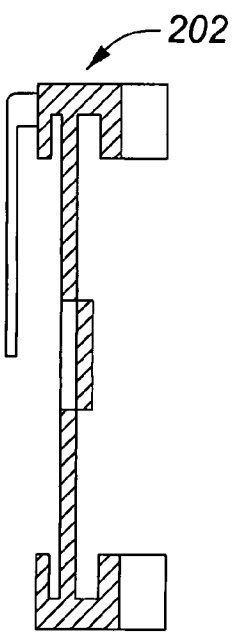

Referring to FIG. 12 and FIG. 13, there is included in this embodiment of the invention, means for detachably securing the first rectangular body (202) to a belt. Second elongate body (204) includes a looping member (350) creating a slot (352). The belt is threaded through the slot thereby fixing the second elongate body to a belt. Means for demountably mounting the second elongate body (204) to the first rectangular body (202) comprises a releasable coupling having a first resilient member (358) mounted to the first rectangular body (202) and a second slot (360) in the elongate body (204) adapted for receiving the first resilient member in a sliding and locking engagement by way of locking stud (364). To remove the second elongate body (204) from its locking engagement with first rectangular body (202) it is a simple matter of depressing locking stud (364) and disengaging it from locking orifice (360).

There is also included finger (370) having a first end (378) fixed to the top portion of the rectangular first body (202) and a second free end (376). Finger (370) fixed end (378) is cohesively fixed by way of an elevating shim (372) to the rectangular first body (202). The finger (370) is mounted to the first rectangular body (202) in such a way so that it is raised creating a gap (374). The finger (379) is positioned adjacent to the open end of the first and second chambers. The finger (370) has an inherent resiliency. Finger (370) and gap (374) are adapted to engage belt (11) in a snug overlapping relationship so as to securely hold device adjacent to and behind the belt.

In addition to the two embodiments present here, a person skilled in the art would recognize that my invention is easily adaptable for secure placement with other hand held devices such as cell phones, PDAs and the like.

Although the description above contains many specifications, these should not be construed as limiting the scope of the invention but as merely providing illustrations of some of the presently preferred embodiments of this invention. Thus the scope of the invention should be determined by the appended claims and their legal equivalents rather than by the examples given.

What is claimed is:

1. An ID/credit card anti-theft device for mounting to a belt having an inside surface and an outside surface, said anti-theft device adapted for placement between said belt inside surface and a waist of a wearer and for securely holding an at least one card, said at least one card having an upper surface and a bottom surface, wherein said ID/credit card anti-theft device comprises a first rectangular body comprising a chamber for receiving and securely holding the at least one card, a second elongate body comprising means for demountably mounting said first rectangular body to the belt and means for sealing the at least one card within said chamber in a locked configuration; and, a biasing element positioned within said chamber, said biasing element adapted for exerting a securing biasing force against said bottom surface of the at least one card contained within the chamber, and wherein the first rectangular body comprises a top portion and a bottom portion joined to said top portion, wherein the joined top portion and bottom portion create the chamber within the rectangular body and wherein; a. said bottom portion comprises a planer upper surface and a concave lower surface and, wherein said planer upper surface forms the chamber floor and said concave lower surface is adapted for comfortable placement against said waist of said wearer; and, b. said top portion comprises a planer lower surface and a convex upper surface and, wherein said planer lower surface forms the chamber ceiling and wherein said convex upper surface is adapted for placement against the inside surface of the belt thereby rendering the anti-theft device invisible.

2. The device as claimed in claim 1, wherein the chamber further includes a first closed side, a second closed side, a first closed end and a second slotted end lockably closeable by said second elongate body, and further wherein, the chamber is adapted to receive an at least one card via said second slotted end in order to hold the at least one card securely.

3. The device as claimed in claim 2 wherein: a. the top portion includes a first centrally positioned oblong cutout adapted to permit sliding thumb contact with said upper surface of the at least one card held in the chamber; and, b. the lower portion includes a second centrally positioned oblong cutout adapted to permit sliding thumb contact with said lower surface of the at least one card held in the chamber, and further wherein, said first centrally positioned oblong cutout and said second centrally positioned oblong cut out are identical in shape and opposed across the chamber.

4. The device as claimed in claim 3, wherein said biasing element comprises a resilient rectangular biasing member: a. having a base fixed cohesively to the floor of the chamber; b. projecting with acclivity; and, c. having a free second end, said free second end having an oblate portion, wherein said oblate portion is adjacent to the first centrally positioned oblong cutout.

5. The device as claimed in claim 4, wherein the slotted second end further includes a T-slot interposed transversely across the second open end, wherein said T-slot has a first open end and a second closed end, and wherein said second closed end includes a locking orifice.

6. The device as claimed in claim 5, wherein the second elongate body is adapted for securely sealing the second slotted end of the first rectangular body, and wherein the second elongate body further comprises a cohesively attached and depending resilient locking member, said locking member having a fixed end fixed to the second elongate body and a free end, and wherein the locking member is adapted for sliding engagement within the T-slot so that when the locking member is fully engaged within the T-slot, the second elongate body seals the entirety of the second slotted end.

7. The device as claimed in claim 6, wherein the locking member includes a locking stud, said locking stud fixed to the free end of the locking member so that, when the locking member is fully engaged within the T-slot, said locking stud is lockingly engaged within said locking orifice.

8. The device as claimed in claim 1, wherein said means for demountably mounting the first rectangular body to the belt comprises a rigid looping member fixed cohesively to the elongate second body, said looping member positioned on the second elongate body so as to create a slot between the second elongate body and the looping member, said slot adapted to receive a belt, and further wherein the looping member has a first end fixed in a pivoting relationship to the second elongate body and a second free end, said second free end adapted for lockable engagement with a raised part on the second elongate body.

9. The device as claimed in claim 8, wherein said looping member second free end includes a triangular shaped orifice, and wherein said raised part on the second elongate body includes a triangular shaped head and, wherein the triangular shaped orifice and the triangular shaped head are adapted for locking and releaseable engagement thereby locking the looping member second free end to the second elongate body.

10. The device as claimed in claim 8, wherein the looping member comprises: a. a first section having a first end fixed to the second elongate body and a second free end having a first groove therein; b. a second section having a first end fixed to the second elongate body and a second free end having a second groove therein, wherein the first section free end and the second section free end are opposed to each other across a gap; c. a third section having a first end and a first tongue, said first tongue adapted for engagement said first groove; a second end and a second tongue, said second tongue adapted for engagement with said second groove and, wherein the third section is lockably removeable from said gap by locking means.

11. The device as claimed in claim 1, wherein means for demountably mounting the rectangular body to a belt includes a resilient finger having a first end fixed to the top portion of the rectangular first body, and a second free end.

12. The device as claimed in claim 11, wherein said finger first fixed end is cohesively fixed by way of an elevating shim to the upper convex surface of the top portion of the first rectangular body so that there is created a gap between the finger and the upper convex surface, said gap adapted to receive a belt in a snug fitting relationship.

13. An ID/credit card anti-theft device for mounting to a belt having an inside surface and an outside surface, said anti-theft device adapted for placement between said belt inside surface and a waist of a wearer and for securely holding an at least one card, said at least one card having a top surface and a bottom surface, said device comprising:

a. a first rectangular body having a flat outer surface for placement against said inside surface of the belt and a concave inner surface adapted for comfortable placement against said waist of said wearer, said first rectangular body adapted to secure said at least one card, the first rectangular body comprising:

i. a first front chamber having an open back end and a front end and disposed adjacent the inside surface of the belt and adapted to receive an at least one card, said first front chamber including:

1. a floor,
2. a top wall having an upper surface and an inside surface, said top wall mounting a restraining member having an upper surface and a lower surface wherein, said top wall upper surface and said top wall mounted restraining member upper surface are flush and contiguous and wherein, the top wall mounted restraining member extends into the first front chamber between said open back end and said front end and wherein, length of the top wall mounted restraining member is equal to the length of the at least one card;
3. a bottom wall having an upper surface and an inside surface and mounting a restraining member having an upper surface and a lower surface wherein, said bottom wall upper surface and said bottom wall mounted restraining member upper surface are flush and contiguous, and wherein, the bottom wall mounted restraining member extends into the first front chamber between the open back end and the front end and wherein, length of the bottom wall mounted restraining member is equal to the length of the at least one card;
4. a front wall having an inside surface adapted to act as an at least one card abutment; and,
5. an open back end whereby the first front chamber accepts an at least one card in a sliding engagement, and wherein, said top wall inside surface, said bottom wall inside surface, said front wall inside surface and said open back end generally define the card dimensions so that when the at least one card is inserted into the first front chamber the at least one card is secured within the first rectangular body; so that when the at least one card is enclosed within the front chamber the top wall inside surface and the bottom wall inside surface are in frictional sliding engagement with the at least one card to restrain it within the first front chamber;

ii. a second rear chamber disposed adjacent the waist of the wearer and adapted to receive an at least one card; and iii. a dividing member for dividing said first front chamber from said second rear chamber; and, b. a second elongate body adapted for locking engagement with the first rectangular body, said second elongate body comprising a looping member creating a slot, said slot adapted for receiving a the belt in a looping relationship so that the first rectangular body is placed invisibly between the inside surface of the belt and the waist of the wearer and secured by locking engagement with said second elongate body; and, c. at least two spaced apart parallel linear embossments in a spaced relationship parallel to the top wall and the bottom wall, said at least two spaced apart parallel linear embossments commencing proximate to the open back end and terminating proximate to the front wall, and wherein the at least two spaced apart parallel linear embossments are adapted to raise the at least one card bottom surface above the floor of the first front chamber.

14. The device as claimed in claim 13, wherein the at least two spaced apart parallel linear embossments and the respective lower surfaces of the top and bottom wall mounted restraining members act cooperatively on the at least one card inserted into the first front chamber so that once the at least one card is inserted into the first front chamber, the respective lower surfaces and of the top and bottom wall mounted restraining members are in sliding frictional engagement with the top surface of the at least one card and the at least two spaced apart linear embossments and are in sliding frictional contact with the lower surface of the at least one card, thereby creating flexure in the at least one card and resulting in biasing forces between the at least one card and the respective lower surfaces of the top and bottom wall mounted restraining members, resulting in the at least one card securely held within the first front chamber.

15. The device as claimed in claim 14, wherein said second rear chamber comprises: a. a floor; b. a second top wall having a upper surface and a inside surface; c. a second bottom wall having a upper surface and a inside surface d. a second front wall adapted to act as a card abutment; and, e. a second open back end whereby the second chamber is adapted to accept an at least one card in a sliding engagement wherein, said second top wall inside surface, said second bottom wall inside surface, said second front wall and said second open back end generally define dimensions of the at least one card, and further wherein, the second top wall inside surface and the second bottom wall inside surface are in frictional sliding engagement with the at least one card.

16. The device as claimed in claim 15, wherein the second chamber further includes: a. a second top wall mounted restraining member having an upper surface and a lower surface wherein, the second top wall upper surface and the second top wall mounted restraining member upper surface are flush and contiguous, and wherein the second top wall mounted restraining member extends into second chamber between the open back end and the front end, and wherein the length of the second top wall mounted restraining member is equal to the length of the second at least one card; b. a second bottom wall mounted restraining member having an upper surface and a lower surface, wherein the second bottom wall upper surface and the second bottom wall mounted restraining member upper surface are flush and contiguous and the second bottom wall mounted restraining member extends into said second chamber between the second open back end and the second front end, and wherein, the length of the second bottom wall mounted restraining member is at least equal to the length of the at least one card, wherein, the second top wall mounted restraining member and the second bottom wall restraining member are parallel and are in positional agreement opposite each other across the first receptacle; and, c. a biasing element rising from the middle the second floor, said biasing element adapted to exert a bias on the bottom surface of the at least one card inserted into the second chamber.

17. The device as claimed in claim 16, wherein said biasing element comprises a resilient rectangular biasing member having a base fixed cohesively to the floor of the chamber, and wherein said biasing member projects with an acclivity from said base, and wherein the biasing member includes a free second end, said free second end having an oblate portion adapted for sliding contact with the bottom surface of the at least one card.

18. The device as claimed in claim 17, wherein the biasing element acts cooperatively with the respective lower surfaces and of the second top and second bottom wall mounted restraining members and on the at least one card inserted into the second chamber, so that the respective lower surfaces and of the second top and bottom wall mounted restraining members and are in sliding frictional engagement with the upper surface of the at least one card, and so that the top oblate surface of the biasing element is in sliding frictional contact with the lower surface of the at least one card thereby creating flexure in the at least one card and resulting in biasing forces between the at least one card and the respective second lower surfaces of the top and bottom wall mounted restraining members that serve to maintain the at least one card securely within the second receptacle.

19. The device as claimed in claim 18, wherein the device further includes a releasable coupling, said coupling comprising a first resilient member mounted to the first rectangular body and a second slot in the elongate body adapted for receiving the first resilient member in a sliding and locking engagement by locking means.

20. The device as claimed in claim 19 wherein the device further includes a finger having a first free end and a second end cohesively fixed to the top portion of the rectangular first body by way of an elevating shim so that a gap is created between said finger and the first rectangular body, said gap adapted to receive a belt in a securing relationship.

* * * * *